US008963653B2

(12) United States Patent
Park

(10) Patent No.: US 8,963,653 B2
(45) Date of Patent: Feb. 24, 2015

(54) 2-CHANNEL DIPLEXER STRUCTURE

(76) Inventor: Yhl Park, Seoul (KR)

( * ) Notice: Subject to any disclaimer, the term of this patent is extended or adjusted under 35 U.S.C. 154(b) by 209 days.

(21) Appl. No.: 13/486,033

(22) Filed: Jun. 1, 2012

(65) Prior Publication Data

US 2012/0313727 A1 Dec. 13, 2012

(30) Foreign Application Priority Data

Jun. 7, 2011 (KR) ..... 10-2011-0054379

(51) Int. Cl.
*H01P 5/12* (2006.01)
*H01P 3/08* (2006.01)
*H01P 1/213* (2006.01)

(52) U.S. Cl.
CPC ..... *H01P 1/2135* (2013.01)
USPC ..... 333/134; 333/127

(58) Field of Classification Search
USPC ..... 333/125–129, 132, 134
See application file for complete search history.

(56) References Cited

U.S. PATENT DOCUMENTS 4,254,385 A * 3/1981 Childs et al. ..... 333/104

* cited by examiner

*Primary Examiner* — Robert Pascal
*Assistant Examiner* — Kimberly Glenn
(74) *Attorney, Agent, or Firm* — Novick, Kim & Lee, PLLC; Jae Youn Kim

(57) ABSTRACT

The present invention relates to a structure of a diplexer that prevents outputs of both signals from influencing each other by removing mutual interference between both signals when a signal having a high pulse frequency and a signal having a low pulse frequency are combined and radiated by using the same antenna, and more particularly, to a 2-channel diplexer structure with two channels in which a substrate having a predetermined size is configured, five microstrip lines are arranged on the top of the substrate to be parallel to each other with a predetermined interval.

1 Claim, 15 Drawing Sheets

2-CHANNEL DIPLEXER STRUCTURE

CROSS-REFERENCE TO RELATED APPLICATION

This application claims under 35 U.S.C. §119 (a) the benefit of Korean Patent Application No. 10-2011-0054379 filed on Jun. 7, 2011, and the entire contents of which are incorporated herein by reference.

BACKGROUND (a) Technical Field

The present invention relates to a structure of a diplexer that prevents outputs of both signals from influencing each other by removing mutual interference between both signals when a signal having a high pulse frequency and a signal having a low pulse frequency are combined and radiated by using the same antenna, and more particularly, to a 2-channel diplexer structure with two channels in which a substrate having a predetermined size is configured, five microstrip lines are arranged on the top of the substrate to be parallel to each other with a predetermined interval wherein a front end of a first microstrip line and a front end of a third microstrip line are connected through a first connection line and a rear end of the third microstrip line and a rear end of a fifth microstrip line are connected through a second connection line to configure one microstrip line of ⊆ shape; a second microstrip line as an individual line is configured between the first microstrip line and the third microstrip line by the first connection line opened to a rear side by the first connection line; a fourth microstrip line as an individual line is configured between the third microstrip line and the fifth microstrip line opened to a front side by the second connection line, including a first port connected with the first connection line; a third port connected to a rear end of the second microstrip line; a fourth port connected with the second connection line; and a third port connected to a front end of the fourth microstrip line.

(b) Background Art

In general, a diplexer uses an LPF and an HPF instead of a BPF unlike a duplexer.

For example, as the diplexer used in the related art, four types (band splitters, wide bandpass diplexer & triplexers, a narrow bandpass diplexer, and a quadrature diplexer) are primarily used.

At present, the diplexer used in a dual-band (tri-mode) communication terminal is almost implemented by a chip.

In this case, as a frequency band used in the diplexer, a frequency band (hereinafter, referred to as cellular) of 824 to 894 MHz (AMPS) and a frequency band of 1850 to 1990 MHz (PCS) are used. The frequency band used in the diplexer serves to separate the duplexer into a cellular duplexer and a PCS duplexer and separate the duplexer into a duplexer for an intermediate-frequency mixer.

Herein, the duplexer is a primary component of a mobile communication terminal that serves to pass only a signal required in calling in connection with an antenna and remove a signal and noise which are unnecessary.

The diplexer in the related art serves to separate the frequencies of 824 to 894 MHz (AMPS) and a frequency band of 1850 to 1990 MHz (PCS) into the cellular duplexer and the PC duplexer in a high-frequency signal received through the antenna (Ant).

The diplexer is most configured by the chip and in terms of a characteristic thereof, insertion loss of a bandpass frequency is maximum 0.7 dB (0.4 dB typ), and isolation is minimum 15 dB.

For reference, the insertion loss (IL) as a result caused by inserting a transducer into a transmission system indicates a ratio of power P2 given to a predetermined place next to a transducer and power P1 given at the same place when the transducer is removed as a decibel (dB).

The isolation represents a power transfer amount from one antenna to another antenna and interantenna isolation indicates a ratio of reception power of another antenna to input power into one antenna as the decibel and a reception power ratio at the Rx side from Tx in RF is also one concept of the isolation.

The insertion loss of the PCS (0.4 dB Typ) and cellular (0.3 dB Typ) band frequencies is designed as approximately 0.7 dB Max (0.4 DB Typ).

Therefore, the diplexer implemented by one chip has a problem that since performance is implemented in the chip while an inputted frequency is separated into a dual band by an internal selection terminal, a coupling phenomenon and higher isolation which are caused therefrom can not obtained.

Since there is a high possibility that the chip will be damaged by heat generated from the chip is high, durability is weak.

In the related art, the diplexer uses a concentrated constant circuit and thus it is impossible to downsize the diplexer.

SUMMARY OF THE DISCLOSURE

The present invention has been made in an effort to solve the above-described problems associated with prior art.

The present invention has been made in an effort to configure a 2-channel diplexer by acquiring transmission characteristics of five microstrip lines, deducing an optimal width of the microstrip line and an interline interval by inducing a scattering constant for determining the transmission characteristic, and adjusting the lengths of second and fourth microstrip lines after matching an input/output load.

An exemplary embodiment of the present invention provides a 2-channel diplexer structure with two channels in which a substrate having a predetermined size is configured, five microstrip lines are arranged on the top of the substrate to be parallel to each other with a predetermined interval, in which a front end of a first microstrip line and a front end of a third microstrip line are connected through a first connection line and a rear end of the third microstrip line and a rear end of a fifth microstrip line are connected through a second connection line to configure one microstrip line of ⊆ shape, a second microstrip line as an individual line is configured between the first microstrip line and the third microstrip line by the first connection line opened to a rear side by the first connection line, a fourth microstrip line as an individual line is configured between the third microstrip line and the fifth microstrip line opened to a front side by the second connection line, and it includes a first port connected with the first connection line, a third port connected to a rear end of the second microstrip line, a fourth port connected with the second connection line, and a third port connected to a front end of the fourth microstrip line.

In this case, a 2-channel diplexer is configured by acquiring transmission characteristics of five microstrip lines by using the lengths of the second microstrip line and the fourth microstrip line, deducing an optimal width of the microstrip line and an interline interval by inducing a scattering constant for determining the transmission characteristic, and adjusting the lengths of second and fourth microstrip lines after matching an input/output load.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
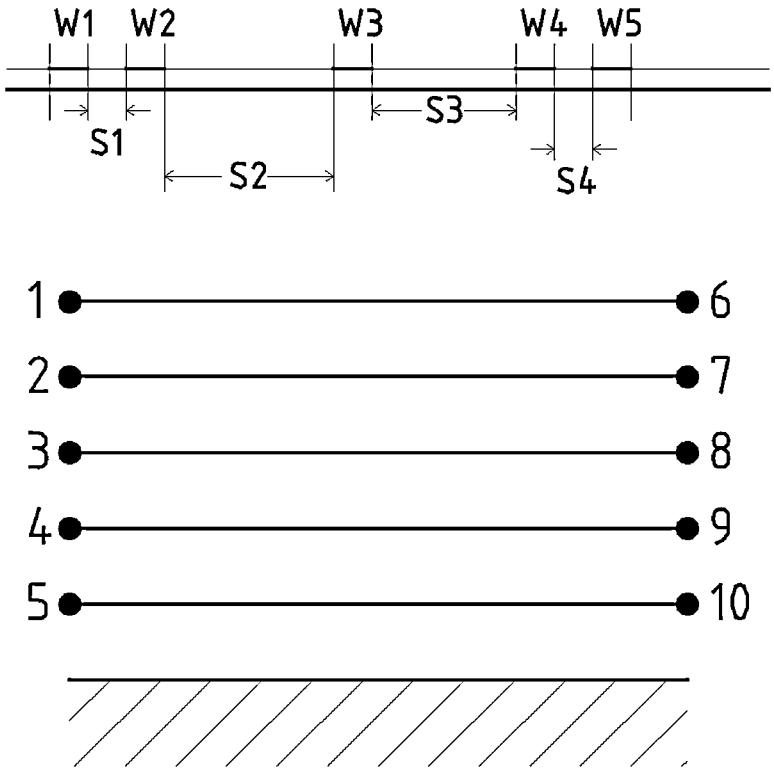
FIG. 1 is a diagram illustrating cross-sections and arrays of five microstrip lines that are parallel to each other and 10 resulting ports.

It should be understood that the appended drawings are not necessarily to scale, presenting a somewhat simplified representation of various preferred features illustrative of the basic principles of the invention.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below.

In order to achieve the object, the present invention will be described below in detail with reference to the accompanying drawings.

In a diplexer, a substrate A having a predetermined size is configured, five microstrip lines are arranged on the top of the substrate A to be parallel to each other with a predetermined interval, in which a front end of a first microstrip line 10 and a front end of a third microstrip line 30 through a first connection line 11 and a rear end of the third microstrip line 30 and a rear end of a fifth microstrip line 50 are connected through a second connection line 12 to configure one microstrip line; a second microstrip line 20 as an individual line is configured between the first microstrip line and the third microstrip line 30 by the first connection line 11 opened to a rear side by the first connection line 11; a fourth microstrip line 40 as an individual line is configured between the third microstrip line 30 and the fifth microstrip line 50 opened to a front side by the second connection line 12, and the diplexer includes: a first port 60 connected with the first connection line 11; a third port 80 connected to a rear end of the second microstrip line 20; a fourth port 90 connected with the second connection line 12; and a third port 70 connected to a front end of the fourth microstrip line 40.

Detailed configurations and exemplary embodiments thereof will be described below with reference to the accompanying drawings.

Figure 2:
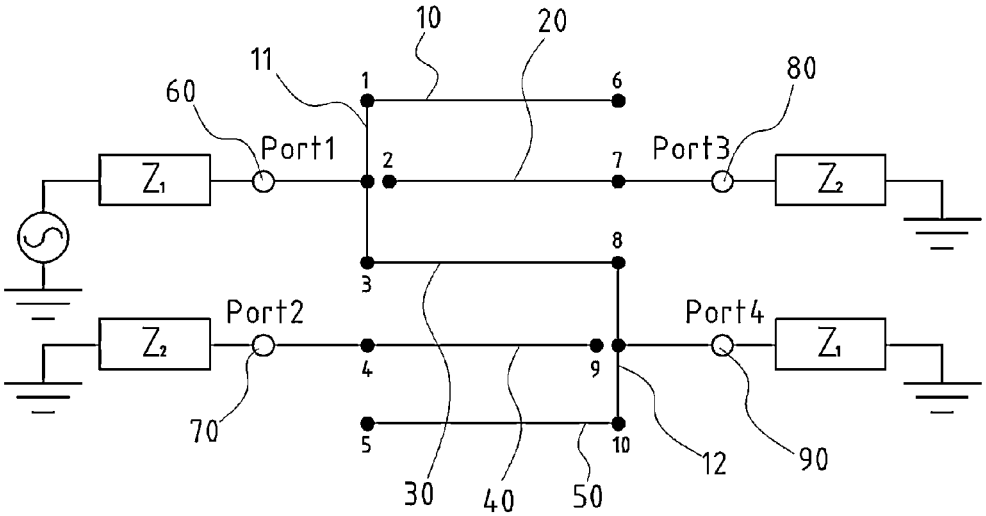
FIG. 2 is a circuit diagram illustrating a configuration of a 2-channel diplexer of the present invention.
Figure 5A:
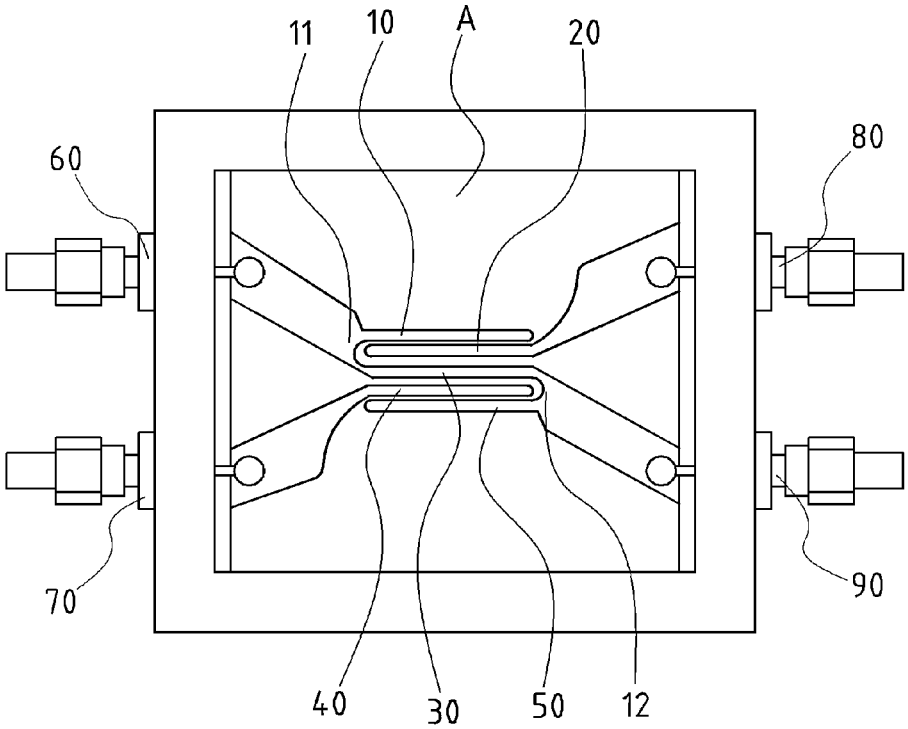
FIG. 5A is a diagram illustrating a state in which the 2-channel diplexer is implemented of the present invention.

A 2-channel diplexer is constituted by five microstrip lines and four ports. First, as shown in FIGS. 2 and 5A, a substrate A having a predetermined size is configured in a housing (not illustrated), five microstrip lines of the first microstrip line 10 to the fifth microstrip line 50 are arranged on the top of the substrate A to be parallel to each other with a predetermined interval, in which the front end of the first microstrip line 10 and the front end of the third microstrip line 30 are connected through the first connection line 11 and the rear end of the third microstrip line 30 and the rear end of the fifth microstrip line 50 are connected through the second connection line 12 to configure one microstrip line of S shape.

In this case, the lengths of the first microstrip line 10, the third microstrip line 30, and the fifth microstrip line 50 are preferably configured with the same length.

A space between the first microstrip line 10 and the third microstrip line 30 connected to each other through the first connection line 11 is opened rearward and the second microstrip line 20 as the individual line is configured between the first microstrip line 10 and the third microstrip line 30, which are opened.

A space between the third microstrip line 30 and the fifth microstrip line 50 connected to each other through the second connection line 12 is opened frontward and the fourth microstrip line 40 as the individual line is configured between the third microstrip line 30 and the fifth microstrip line 50, which are opened.

The first port 60 is configured to be connected with the first connection line 11, the third port 80 is configured to be connected to the rear end of the second microstrip line 20, the fourth port 90 is configured to be connected with the second connection line 12, and the second port 70 is configured to be connected to the front end of the fourth microstrip line 40.

The exemplary embodiments of the present invention will be described below.

First, a theoretical fact should be certified in order to implement the present invention. FIG. 1 illustrates cross-sections and arrays of five microstrip lines that are parallel to each other and 10 ports configured at terminals of five microstrip lines. When five microstrip lines are configured to be arranged in parallel to each other and current and voltage of each terminal at ten ports connected to the terminals of five microstrip lines is set as I, V matrix and corresponding admittance is set as Y matrix as illustrated in FIG. 1, the following equation can be induced.

$$I=YV \tag{1}$$

Herein, I, V is an array vector of 10 rows and Y is a 10×10 matrix.

FIG. 2 is a circuit diagram illustrating a configuration of a 2-channel diplexer. When the 2-channel diplexer is constituted by four ports, voltage and current at each port terminal are given by the following equation.

$$I_A=I_1+I_3 I_B=I_4 I_C=I_7 I_D=I_8+I_{10},,,$$

$$I_2=I_5=I_6=I_9=0.$$

$$V_A=V_1=V_3 V_B=V_4,$$

$$V_C=V_7 V_D=V_8=V_{10}, \tag{2}$$

$I_A$: current of first port, $I_B$: current of second port, $I_C$: current of third port $I_D$: current of fourth port, $V_A$: voltage of first port, $V_B$: voltage of second port $V_C$: voltage of third port, $V_D$: voltage of fourth port Four port equivalent admittances $Y_e$ of the first to fourth ports are given by the following equation.

$$Y_e=Y_p-Y_q\times Y_r^{-1}Y_t \tag{3}$$

When a set of respective current nodes of the first port, the second port, the third port, and the fourth port is represented by $\Sigma Y_{i,j,k,l}$, voltage nodes are represented by $V_i$, $V_j$, $V_k$, and $V_l$, terminal voltage other than the first to fourth ports is represented by $V_p$, $V_q$, $V_r$, and $V_s$, an admittance matrix among the port terminals is represented by $Y_p$.

$$Y_p\begin{bmatrix} \sum\sum Y_{ii} & \sum\sum Y_{ij} & \sum\sum Y_{ik} & \sum\sum Y_{il} \\ \sum\sum Y_{ji} & \sum\sum Y_{jj} & \sum\sum Y_{jk} & \sum\sum Y_{jl} \\ \sum\sum Y_{ki} & \sum\sum Y_{kj} & \sum\sum Y_{kk} & \sum\sum Y_{kl} \\ \sum\sum Y_{li} & \sum\sum Y_{lj} & \sum\sum Y_{lk} & \sum\sum Y_{ll} \end{bmatrix}= \tag{4}$$

An admittance among the first port, the second port, the third port, and the fourth port terminals and the terminals other than the ports is represented by $Y_q$.

$$Y_q\begin{bmatrix} \sum\sum Y_{ip} & \sum\sum Y_{iq} & \sum\sum Y_{ir} & \sum\sum Y_{is} \\ \sum\sum Y_{jp} & \sum\sum Y_{jq} & \sum\sum Y_{jr} & \sum\sum Y_{js} \\ \sum\sum Y_{kp} & \sum\sum Y_{kq} & \sum\sum Y_{kr} & \sum\sum Y_{ks} \\ \sum\sum Y_{lp} & \sum\sum Y_{lq} & \sum\sum Y_{lr} & \sum\sum Y_{ls} \end{bmatrix}= \tag{5}$$

An admittance among the terminals other than the first port, the second port, the third port, and the fourth port terminals and the first, second, third, and fourth port terminals is represented by $Y_r$.

$$Y_r\begin{bmatrix} \sum\sum Y_{\pi} & \sum\sum Y_{pj} & \sum\sum Y_{pk} & \sum\sum Y_{pl} \\ \sum\sum Y_{qi} & \sum\sum Y_{qj} & \sum\sum Y_{qk} & \sum\sum Y_{ql} \\ \sum\sum Y_{ri} & \sum\sum Y_{rj} & \sum\sum Y_{rk} & \sum\sum Y_{rl} \\ \sum\sum Y_{si} & \sum\sum Y_{sj} & \sum\sum Y_{sk} & \sum\sum Y_{sl} \end{bmatrix}= \tag{6}$$

In addition, an admittance among the terminals other than the first port, second, third, and fourth port terminals is represented by $Y_t$.

$$Y_t\begin{bmatrix} \sum\sum Y_{pp} & \sum\sum Y_{pq} & \sum\sum Y_{pr} & \sum\sum Y_{ps} \\ \sum\sum Y_{qp} & \sum\sum Y_{qq} & \sum\sum Y_{qr} & \sum\sum Y_{qs} \\ \sum\sum Y_{rp} & \sum\sum Y_{rq} & \sum\sum Y_{rr} & \sum\sum Y_{rs} \\ \sum\sum Y_{sp} & \sum\sum Y_{sq} & \sum\sum Y_{sr} & \sum\sum Y_{ss} \end{bmatrix}= \tag{7}$$

Therefore, the equivalent admittance of the present invention according to the equation is acquired by applying the conditions of Equations (1) and (2), acquiring Equations (4), (5), (6), and (7), and substituting the equations into Equation (3).

$Y_e$ is the 4×4 matrix and the first port, the second port, the third port, and the fourth port are determined as 1, 2, 3, and 4 as follows in FIG. 2.

$$Y_e\begin{pmatrix} Y_{11} & Y_{12} & Y_{13} & Y_{14} \\ Y_{21} & Y_{22} & Y_{23} & Y_{24} \\ Y_{31} & Y_{32} & Y_{33} & Y_{34} \\ Y_{41} & Y_{42} & Y_{43} & Y_{44} \end{pmatrix}=$$

In addition, scattering matrices of the first port, the second port, the third port, and the fourth port are acquired by the following relational equation.

$$[S]\{U-Y_n\}\{U-Y_n\}^{-1}=\{Z_N-U\}\{Z_N+U\}^{-1}=$$

Herein, U represents a unit matrix.

$$Y_n[Z_0]^{1/2}[Y_e][Z_0]^{1/2}=Z_0\begin{pmatrix} Z_1 & 0 & 0 & 0 \\ 0 & Z_2 & 0 & 0 \\ 0 & 0 & Z_2 & 0 \\ 0 & 0 & 0 & Z_1 \end{pmatrix}=$$

A scattering parameter S' of an optimal impedance of the input/output port is acquired by an impedance renormalization method depending on loads $Z_1$ and $Z_2$.

The optimal impedance is fixed to $Z_1$, $Z_2$ is fixed at $S'_{22}0$, and $Z_1$ is acquired at $S'_{11}0$.

The relational equation is given as follows.

$$[S']=\{[Z_d]+[Z_S][S]\}\{[Z_S]+[Z_d][S]\}^{-1}$$

$$[Z_S]/[Z_d]$$

Herein, $[Z_S]$ and $[Z_d]$ are diagonal matrices and components thereof are as follows.

$$Z_{si}\approx\sqrt{\frac{Z_{io}}{Z_i}}+\sqrt{\frac{Z_i}{Z_{io}}}$$

$$Z_{di}\approx\sqrt{\frac{Z_{io}}{Z_i}}+\sqrt{\frac{Z_i}{Z_{io}}}$$

Herein, $Z_{io}$ represents an impedance of port i.

$$S'_{22} = 0 \quad 1)$$

$$Z_1 = Z_{1o}\sqrt{\left(\frac{k}{2}-1\right)\left(\frac{k}{2}+1\right)}$$

$$k = (S_{14}^2 - S_{11}^2 - 1)/S_{11}$$

$$S'_{22} = 0 \quad 2)$$

$$Z_2 = Z_{2o}\sqrt{\left(\frac{k}{2}-1\right)\left(\frac{k}{2}+1\right)}$$

$$k = (S_{23}^2 - S_{22}^2 - 1)/S_{11}$$

The 2-channel diplexer is configured by acquiring transmission characteristics of five microstrip lines, deducing an optimal width of the microstrip line and an interline interval by inducing a scattering constant for determining the transmission characteristic, and adjusting the lengths of the second and fourth microstrip lines 20 and 40 after matching an input/output load.

A simulation result of the present invention is as follows.

First, a response simulation is executed by setting a central frequency to 4 GHz, applying a Teflon value in which a relative dielectric constant is 2.22 and a dielectric thickness is 60 [mil] to the substrate, and setting a line width and an interline interval to the following values.

$W_i$=1200 [mil], i=1, 2, 3, 4, 5.

$S_1$=600 [mil], $S_2$=1500 [mil], $S_3$=1200 [mil], $S_4$=600 [mil]

Figure 3:
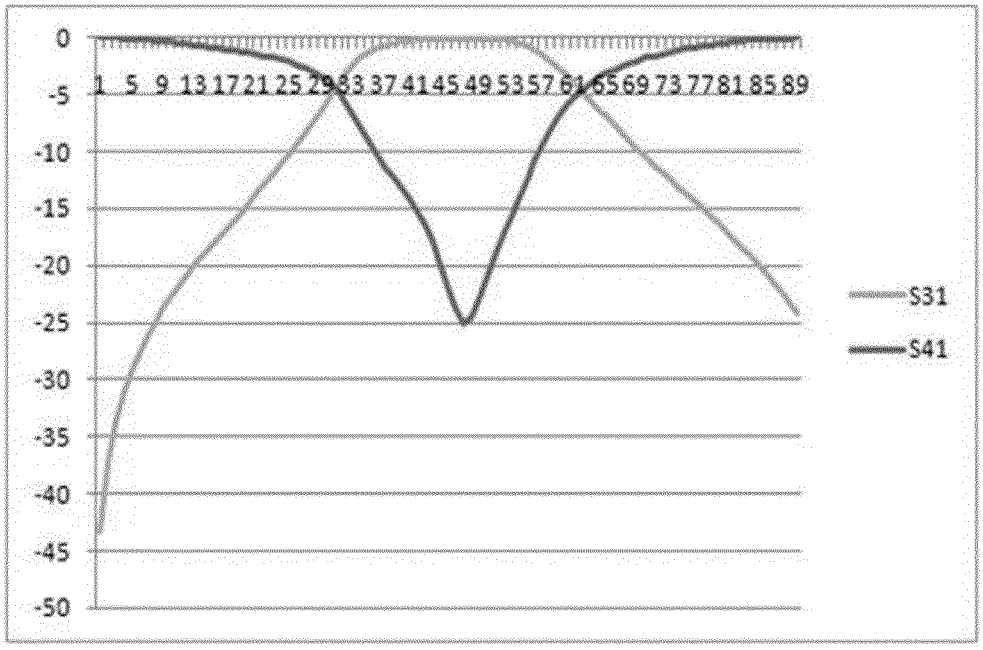
FIG. 3 is a graph illustrating a response simulation result of a first port according to the present invention.

A result of the response simulation of the first port according to the present invention may be acquired as illustrated in FIG. 3. A total effective dielectric constant of a part coupled to the fifth microstrip line 50 from the first microstrip line 10 is calculated as 1.711.

The input and output loads in simulation are set to 35 ohm and 25 ohm, respectively, and matched to 50 ohm, a characteristic impedance of the input/output line, and a matching line is formed by a ¼ wavelength matching method.

Effective dielectric constants of respective input and output matching units are 1.914 and 1.893 and a difference therebetween is just 0.02, and as a result, the taper lengths thereof are the same as each other.

Figure 4:
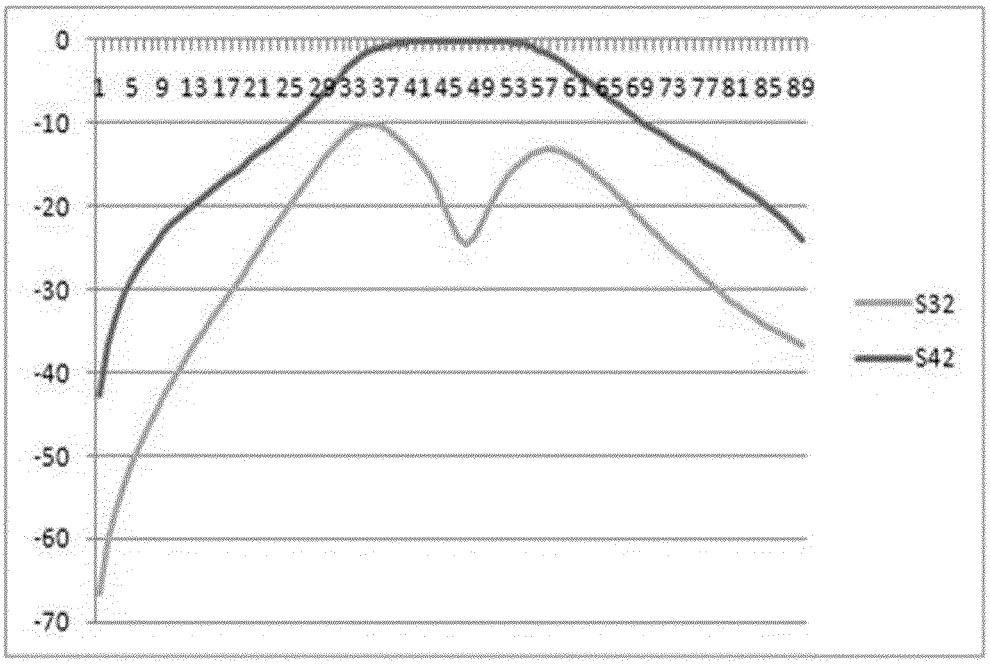
FIG. 4 is a graph illustrating a response simulation result of a second port according to the present invention.

A result of the response simulation of the second port according to the present invention may be acquired as illustrated in FIG. 4. FIG. 5A is a diagram illustrating a state in which the 2-channel diplexer is implemented according to the present invention.

The implemented exemplary embodiment of the present invention will be described below.

Figure 5B:
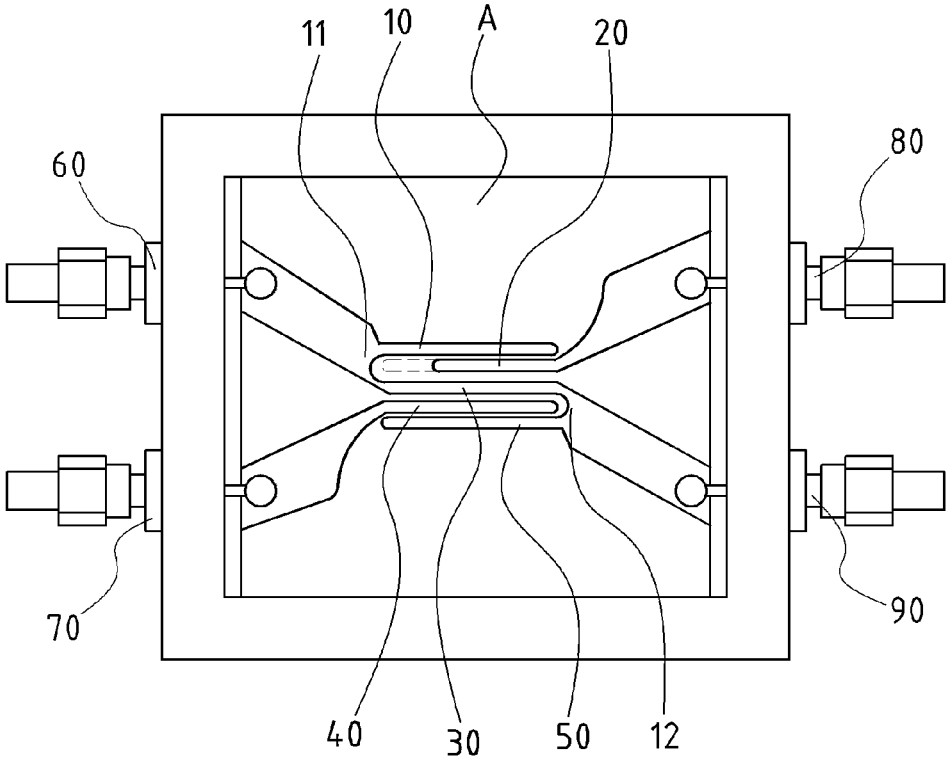
FIG. 5B is a diagram illustrating a state in which a second microstrip line according to the present invention is adjusted to be approximately ⅖ shorter.

FIG. 5B illustrates a configuration of a diplexer in which the length of the second microstrip line 20 is adjusted. When characteristics of the diplexer in which the length of the second microstrip line 20 is adjusted to be ⅖ shorter are measured, the measured characteristics are illustrated in FIGS. 6 and 7.

Figure 6:
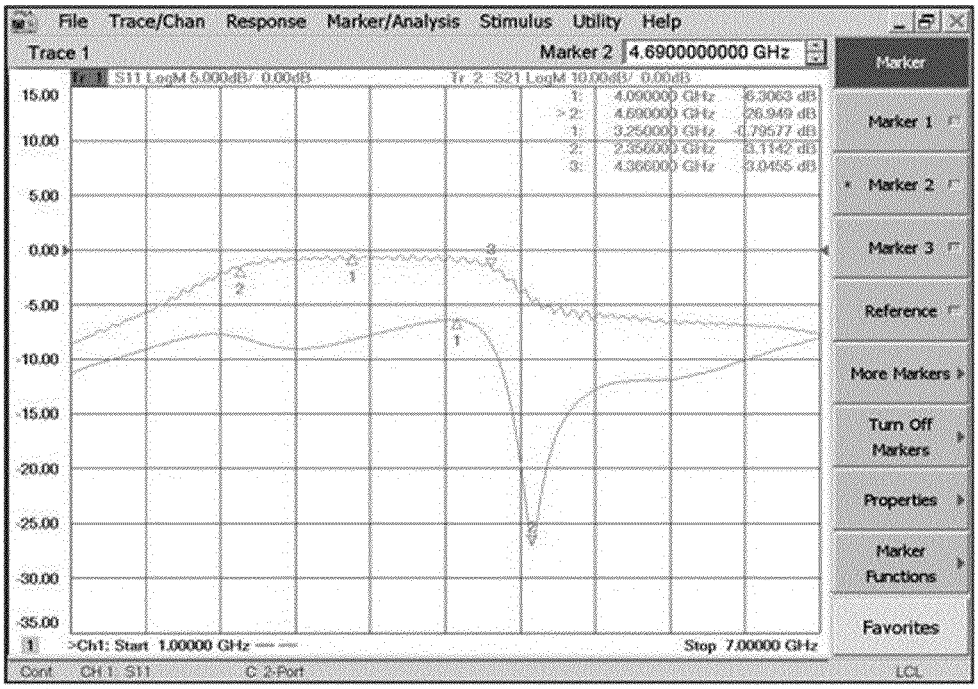
FIG. 6 is a graph illustrating a characteristic of S31 before adjusting the second microstrip line according to the present invention.
Figure 7:
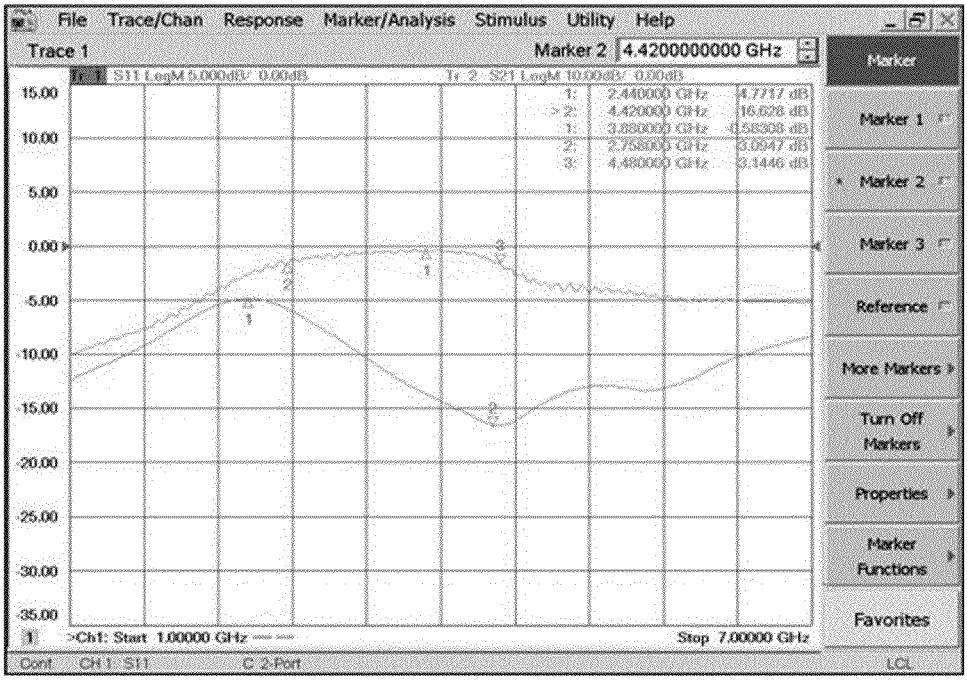
FIG. 7 is a graph illustrating measurement of the characteristic of S31 after adjusting the second microstrip line according to the present invention.

FIG. 6 is a diagram illustrating measurement of a characteristic S31 while the length of the second microstrip line 20 is not adjusted, and FIG. 7 is a diagram illustrating the measurement of characteristic S31 while the length of the second microstrip line 20 is adjusted to be ⅖ shorter.

As illustrated in FIGS. 6 and 7, in a bandwidth of 3 dB, 2 GHz is reduced to 1.7 GHz band from 2 GHz by approximately 0.3 GHz, S11 is enhanced by 8 dB in a band of 4 GHz, and minimum attenuation is improved by 0.2 dB in a passband.

However, S32, the characteristic for the second port 70 is not particularly influenced by a change as attenuation is increased from minimum −25 dB to −26 dB in the 4 GHz band unlike the first port 60.

Figure 8:
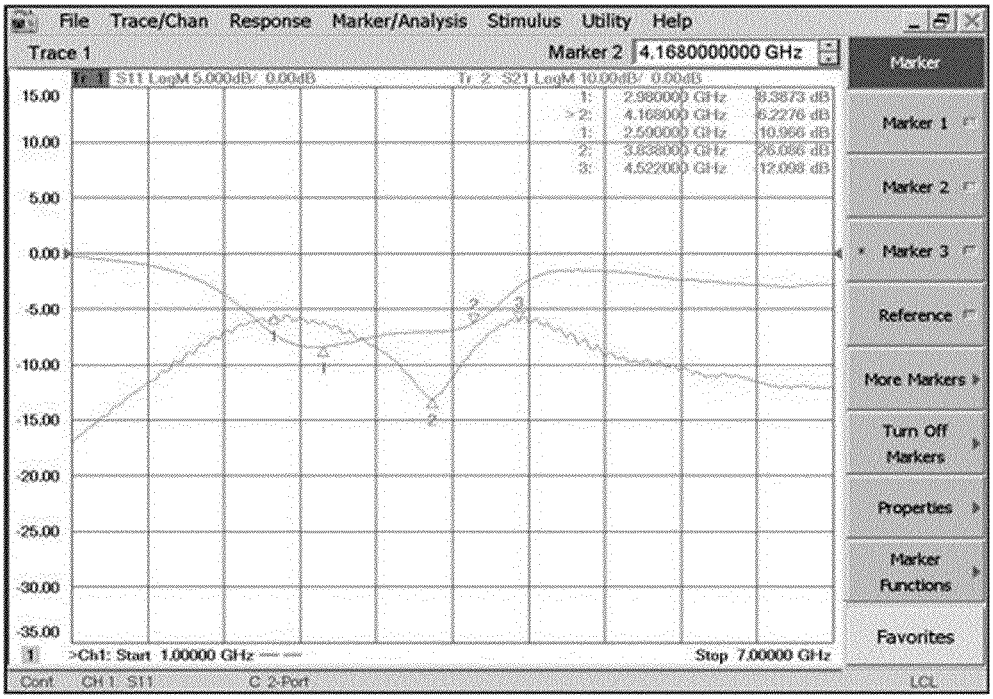
FIG. 8 is a graph illustrating a characteristic of S32 after adjusting the second microstrip line.

The changed result is illustrated in FIG. 8 and the characteristic reacts similarly as the characteristic in the original form.

Figure 9:
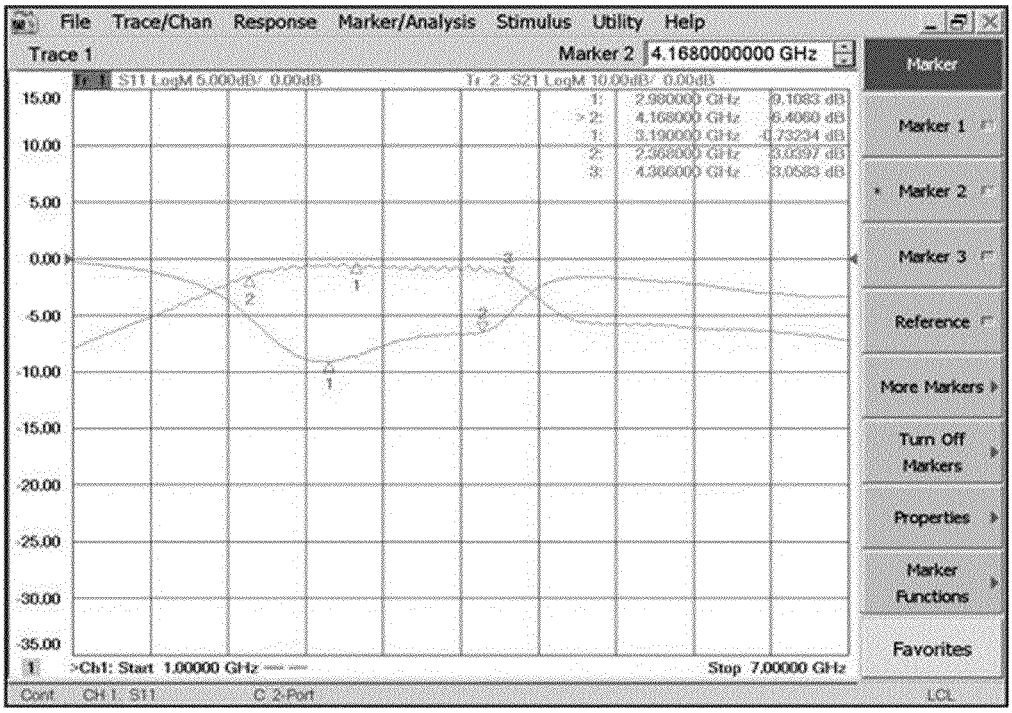
FIG. 9 is a graph illustrating a characteristic of S42 after adjusting the second microstrip line.

A characteristic of the fourth port 90 is measured as illustrated in FIG. 9.

S42 shows a change from 1.9 GHz to 2.0 GHz in the bandwidth and S22 shows a change from −8 dB to −9 dB, as results before and after the length of the second microstrip line 20 is changed.

Figure 10:
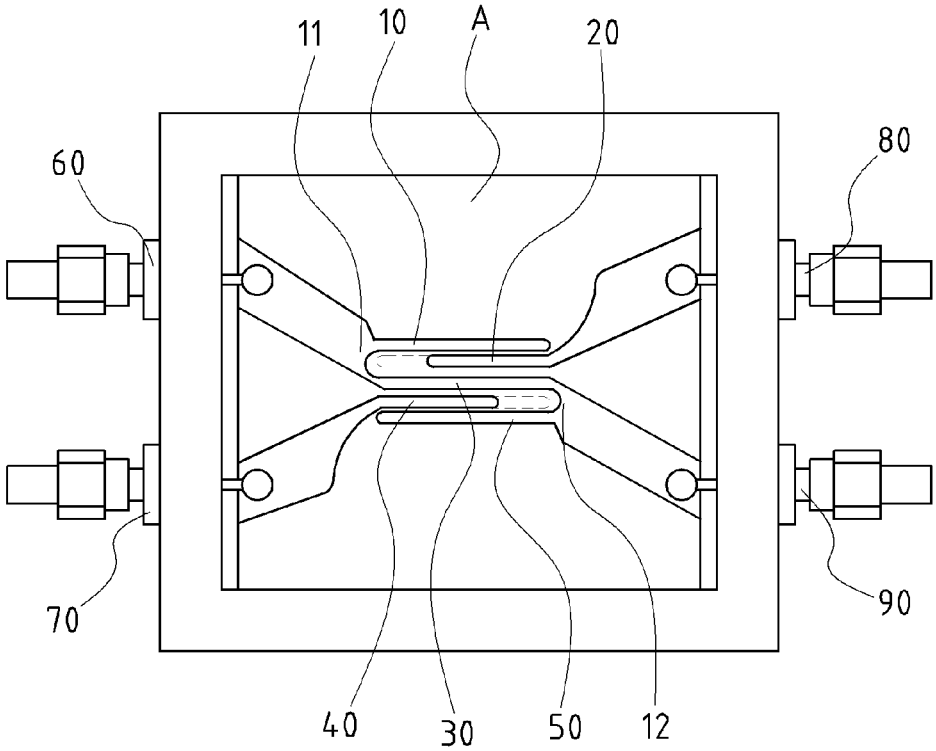
FIG. 10 is a structure in which the second/fourth microstrip line of the diplexer is adjusted.

FIG. 10 illustrates a configuration of a diplexer in which the lengths of both the second microstrip line 20 and the fourth microstrip line 40 are adjusted. When a characteristic of the diplexer in which the lengths of both the second microstrip line and the fourth microstrip line 40 are adjusted to be approximately ⅖ shorter, the measured characteristic is illustrated in FIGS. 11 to 14.

Figure 11:
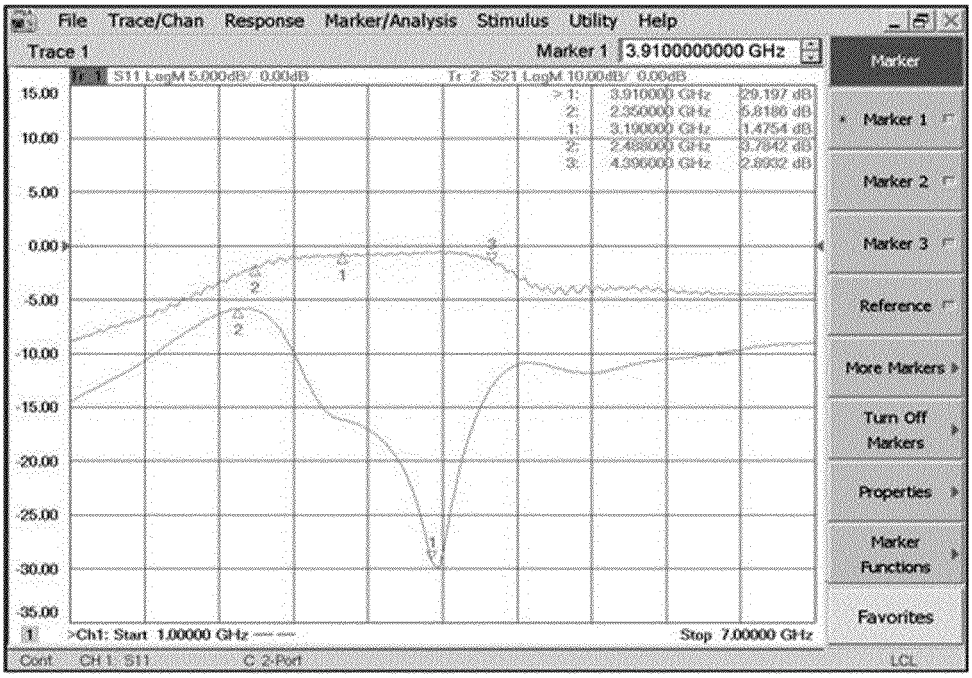
FIG. 11 is a graph illustrating a characteristic of S31 at the time of adjusting the second/fourth microstrip line.
Figure 12:
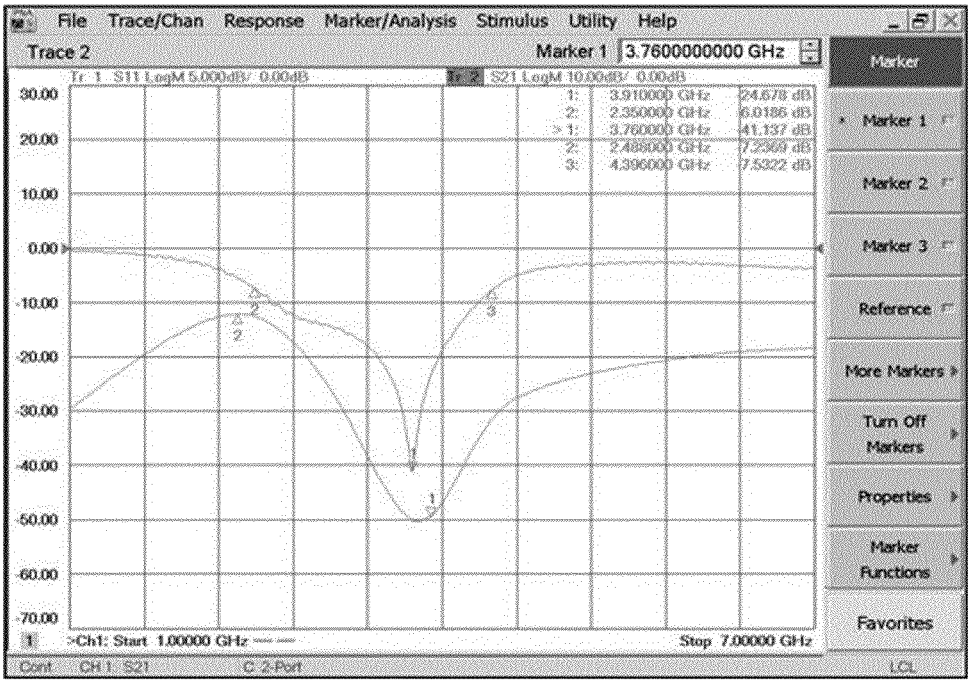
FIG. 12 is a graph illustrating a characteristic of S41 at the time of adjusting the second/fourth microstrip line.
Figure 13:
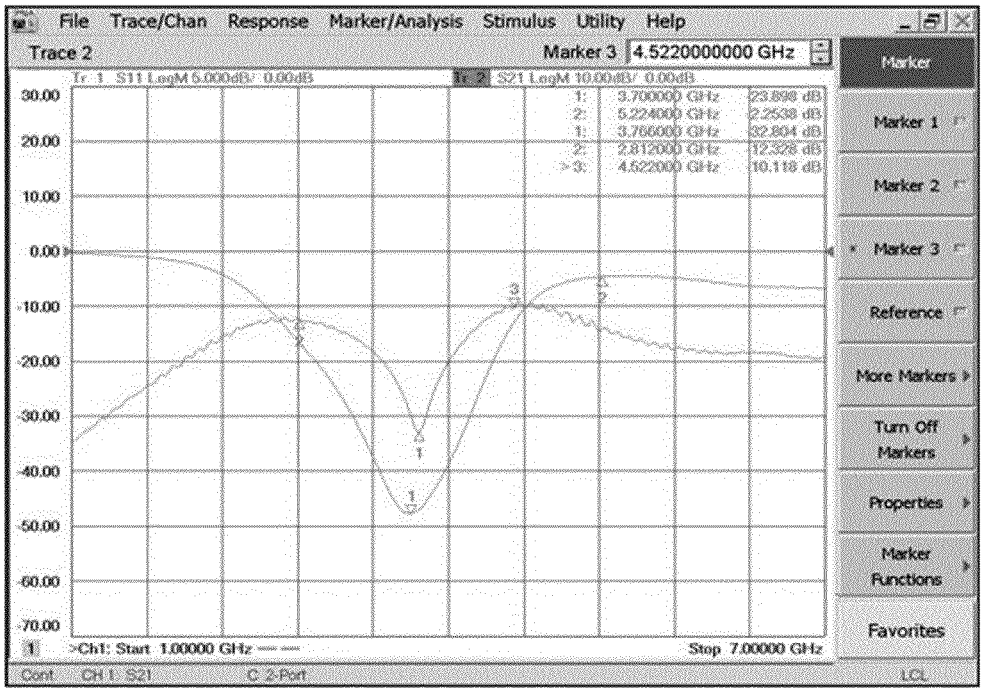
FIG. 13 is a graph illustrating a characteristic of S32 after adjusting the second/fourth microstrip line.
Figure 14:
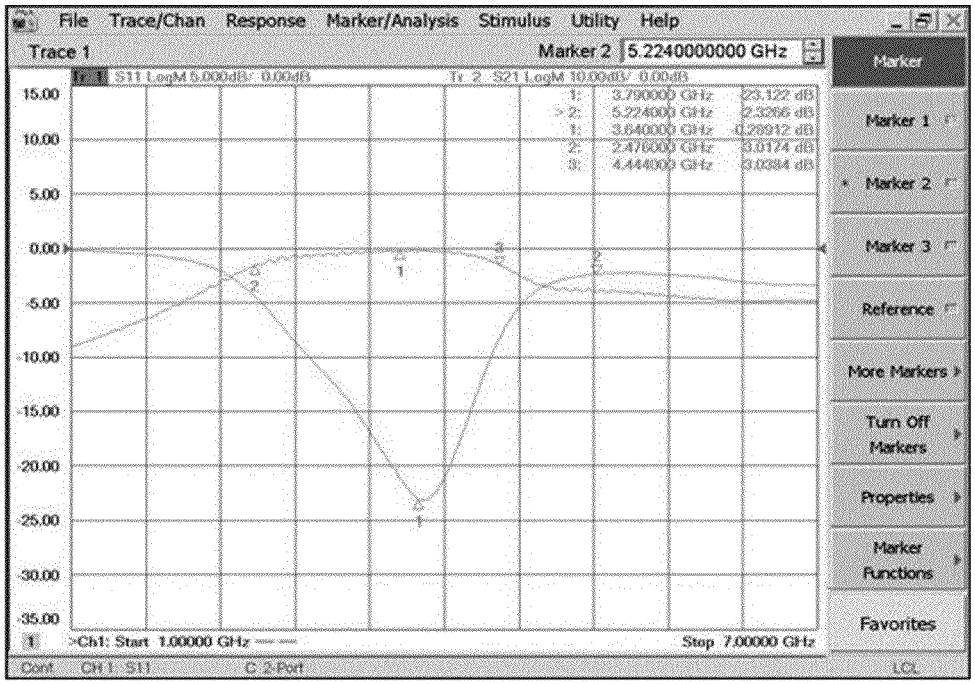
FIG. 14 is a graph illustrating a characteristic of S42 at the time of adjusting the second/fourth microstrip line.

FIG. 11 is a diagram illustrating measurement of the characteristic of S31 when the lengths of the second microstrip line 20 and the fourth microstrip line 40 are adjusted, FIG. 12 is a diagram illustrating measurement of the characteristic of S41 when the lengths of the second microstrip line 20 and the fourth microstrip line 40 are adjusted, FIG. 13 is a diagram illustrating measurement of the characteristic of S32 when the lengths of the second microstrip line 20 and the fourth microstrip line 40 are adjusted, and FIG. 14 is a diagram illustrating measurement of the characteristic of S42 when the lengths of the second microstrip line 20 and the fourth microstrip line 40 are adjusted.

As illustrated in FIGS. 11 and 12, in S31 and S41 in the first port 60 and S32 and S42 in the second port 70, the bandwidth is not reduced as compared with the case where only the second microstrip line 20 is adjusted and is restored similarly as a characteristic of an original length in terms of the passband characteristic.

In an attenuation band, both S32 and S41 show maximum attenuation in 3.76 GHz.

In S31, the bandwidth of 3 DB is extended by 0.2 MHz as compared with the case where the second microstrip line 20 is adjusted, and as a result, S31 is similar as the case where the length is not adjusted.

S11 as an input reflection coefficient is improved by 13 dB from −16 dB to −29 dB and S32 corresponding to the isolation is improved by 6 dB from −26 dB to −32 dB.

In S41, the maximum attenuation frequency is decreased from 3.82 GHz to 3.76 GHz as compared with the second microstrip line 20 and the reflection coefficient S11 shows the minimum value in a frequency close to the central frequency as compared with the case where the second microstrip line 20 is adjusted to the minimum value in 4 GHz.

An attenuation amount between the first port 60 and the fourth port 90 increases from −33 dB to −41 dB by −8 dB, and as a result, the isolation is improved. In S42, the bandwidth of 3 dB is decreased from 2 MHz to 1.67 MHz by 0.33 MHz. S11, the input reflection coefficient in the second port 70 is significantly decreased from −9 dB to −23 dB.

Accordingly, as described above, interline intervals of five microstrip lines are configured to be different from each other and a change in the bandwidth is tested by changing the lengths of the second microstrip line 20 and the fourth microstrip line 40 to serve as the diplexer. Two ports among four ports constitute one channel to serve as the 2-channel diplexer.

Since a 2-channel diplexer is configured by acquiring transmission characteristics of five microstrip lines, deducing an optimal width of the microstrip line and an interline interval by inducing a scattering constant for determining the transmission characteristic, and adjusting the lengths of second and fourth microstrip lines after matching an input/output load, the size of the 2-channel diplexer can be adjusted according to selection of a dielectric constant and durability thereof is excellent due to its simple structure.

Since the diplexer is configured by only the microstrip line, the device can be miniaturized and thinned because there is no part occupying a space as a plane circuit form.

While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

What is claimed is:

1. A 2-channel diplexer structure, comprising:

a substrate having a predetermined size;

five microstrip lines arranged on a top of the substrate to be parallel to each other with a predetermined interval, in which a front end of a first microstrip line and a front end of a third microstrip line are connected through a first connection line and a rear end of the third microstrip line and a rear end of a fifth microstrip line are connected through a second connection line to configure one microstrip line of ⊆ shape;

a second microstrip line as an individual line configured between the first microstrip line and the third microstrip line by the first connection line opened to a rear side by the first connection line;

a fourth microstrip line as an individual line configured between the third microstrip line and the fifth microstrip line opened to a front side by the second connection line;

a first port connected with the first connection line;

a third port connected to a rear end of the second microstrip line;

a fourth port connected with the second connection line; and a third port connected to a front end of the fourth microstrip line, wherein transmission characteristics of the microstrip lines are acquired by using the lengths of the second microstrip line and the fourth microstrip line, an optimal width of the microstrip line and an interline interval is deduced by inducing a scattering constant for determining the transmission characteristics, and the lengths of second and fourth microstrip lines are adjusted after matching an input/output load.

* * * * *